US006039506A

United States Patent [19]

Khachaturian

[11] Patent Number: 6,039,506

[45] Date of Patent: Mar. 21, 2000

[54] METHOD AND APPARATUS FOR THE OFFSHORE INSTALLATION OF MULTI-TON PACKAGES SUCH AS DECK PACKAGES AND JACKETS

[76] Inventor: Jon E. Khachaturian, 5827 Rhodes Ave., New Orleans, La. 70131

[ * ] Notice: This patent is subject to a terminal disclaimer.

[21] Appl. No.: 08/925,929

[22] Filed: Sep. 8, 1997

[51] Int. Cl.[7] ..... E02B 17/00

[52] U.S. Cl. ..... 405/204; 405/209

[58] Field of Search ..... 405/204, 209, 405/203, 196; 114/44, 51, 50, 264, 265

[56] References Cited

U.S. PATENT DOCUMENTS

| | | | |
|---|---|---|---|
| 928,536 | 7/1909 | Pino | 114/51 |
| 1,710,103 | 4/1929 | Nelson | 114/51 |
| 2,598,088 | 5/1952 | Wilson | 61/46 |
| 3,977,346 | 8/1976 | Natvig et al. | 114/65 R |
| 4,242,011 | 12/1980 | Karsan et al. | 405/204 |
| 4,249,618 | 2/1981 | Lamy | 405/204 X |
| 4,252,468 | 2/1981 | Blight | 405/204 |
| 4,252,469 | 2/1981 | Blight et al. | 405/204 |
| 4,714,382 | 12/1987 | Khachaturian | 405/204 |
| 4,744,697 | 5/1988 | Coppens | 405/204 |
| 5,037,241 | 8/1991 | Vaughn et al. | 405/209 |

*Primary Examiner*—Hoang Dang
*Attorney, Agent, or Firm*—Garvey, Smith, Nehrbass & Doody, LLC

[57] ABSTRACT

A method and apparatus for the installation or removal of large multi-ton prefabricated deck packages includes the use of usually two barges defining a base that can support a large multi-ton load. A variable dimensional truss assembly is supported by the barge and forms a load transfer interface between the barge and the deck package. Each boom has a lifting end portion with a roller that fits a receptacle on the package. Tensile connections form attachments between the deck package and barge at a lower elevational position. The variable dimension truss includes at least one member of variable length, in the preferred embodiment being a winch powered cable that can be extended and retracted by winding and unwinding the winch.

20 Claims, 10 Drawing Sheets

METHOD AND APPARATUS FOR THE OFFSHORE INSTALLATION OF MULTI-TON PACKAGES SUCH AS DECK PACKAGES AND JACKETS

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the placement of large multi-ton prefabricated deck packages (e.g. oil and gas platforms, oil rigs) in an offshore environment upon a usually partially submerged jacket that extends between the seabed and the water surface. Even more particularly, the present invention relates to the use of a moving lifting assembly which is preferably barge supported that can place a very large deck package upon an offshore marine jacket foundation without the use of enormous lifting booms such as form a part of derrick barges, offshore cranes, and the like, and wherein opposed short booms are connected with a frame or compressive spreader members that enable use of suspended slings to lift the deck package 2. General Background In the offshore oil and gas industry, the search for oil and gas is often conducted in a marine environment. Sometimes the search takes place many miles offshore. Oil and gas well drilling takes place in many hundreds of feet of water depth.

The problem of drilling oil wells offshore and then producing these wells has been solved in part by the use of enormous fixed or floating platform structures with foundations that are mostly submerged, but usually extending a number of feet above the water surface. Upon this foundation (or "jacket", tension leg platform ("TLP"), or SPAR, etc. as it is called in the art) there is usually placed a very large prefabricated rig or deck platform. The term "deck platform" as used herein should be understood to include any of a large variety of prefabricated structures that are placed on an offshore foundation to form a fixed or floating offshore platform. Thus, a "deck-platform" can include, e.g. a drilling rig, a production platform, a crew quarters, living quarters, or the like.

As an example of one offshore foundation, a supporting jacket is usually a very large multi-chord base formed of multiple sections of structural tubing or pipe that are welded together. Such jackets have been used for a number of years for the purpose of supporting large deck platforms in an offshore environment.

The jacket or foundation is usually prefabricated on land in a fabrication yard, preferably adjacent to a navigable waterway. The completed jacket can be placed upon a large transport barge so that it can be moved to the drill site where it will be placed upon the ocean floor. As an example, an offshore jacket can be several hundred feet in length. The size of the jacket is of course a function of the depth of water in which the rig will be placed. A five hundred (500) foot water depth at the drill site (or production site) will require a jacket which is approximately 500–550 feet tall. The jacket is usually partially submerged, with only a small upper portion of the jacket extending slightly above the water surface. An offshore jacket as described and in its position on the seabed can be seen, for example, in the Blight, et al U.S. Pat. No. 4,252,469 entitled "Method and Apparatus for installing integrated Deck Structure and Rapidly Separating Same from Supporting Barge Means." Specifically, FIGS. 1, 2 and 3 of the Blight, et al patent show an offshore jacket on the seabed.

A small upper portion of the jacket extends above the water surface. This exposed portion of the jacket is the portion upon which the "deck platform" is placed and supported by. This upper portion of the jacket is usually equipped with a number of alignment devices which enhance the proper placement of the deck package on the jacket. Such alignment devices are referred to variously as stabbing eyes, sockets, or the like. The use of such alignment devices, sockets, or stabbing eyes can be seen in the Blight, et al U.S. Pat. Nos. 4,252,468 and 4,252,469 as well as in the Kansan U.S. Pat. No. 4,242,011. For purposes of background and reference, the Kansan U.S. Pat. No. 4,242,011 is incorporated herein by reference. The Blight, et al U.S. Pat. Nos. 4,252,469 and 4,252,468 are likewise each incorporated herein by reference.

Deck platforms or topsides can be extremely large and have correspondingly heavy weights. For example, it is not uncommon for a deck platform such as a drilling rig crew quarters, production platform or the like to be between five hundred and five thousand (500 and 5,000) tons gross weight. Topsides in excess of ten thousand (10,000) tons have been installed, and others that are being planned may weigh as much as thirty thousand (30,000) tons. Such enormous load values present significant problems in the placement of deck platforms on offshore jacket structures. First, the placement is done entirely in a marine environment. While the jacket can be laid on its side and/or floated into position, the platform is not a submersible structure, and must be generally supported in an upright condition above the water surface to prevent water damage to the many components that form a part of the drilling or production platform (such as electrical systems, wall constructions, and other portions that will be inhabited by individuals and used as oil and gas well drilling or production equipment).

The art has typically used enormous derrick barges for the purpose of setting or placing deck packages on jackets in an offshore environment. These derrick barges are large, rectangular barge structures with a high capacity lifting boom mounted at one end portion of the deck of the barge. The barge, for example might be three hundred to four hundred (300–400) feet in length, fifty to seventy five (50–75) feet in width, and twenty-five to fifty (25–50) feet deep. These figures are exemplary.

A derrick barge might have a lifting capacity of for example, two thousand (2,000) tons. For very large structures such as for example, a five thousand (5,000) ton deck package, two derrick barges can be used, each supporting one side portion of the deck platform with a multi-line lift system supported by an enormous structural boom extending high into the air above the package during the lift.

The boom simply works in the same way as an anchor lifting boom, namely the loadline raises and/or lowers the package into its proper position upon the jacket. While the use of such derrick barges has been very successful in the placing of offshore deck packages on jackets through the years, such derrick barges are generally limited in their capacity to packages of two thousand (2,000) tons or less. Further, derrick barges of such an enormous capacity are extremely expensive to manufacture and operate. Many thousand of dollars per hour as a cost of using such a device is not uncommon. Although there are five (5) or six (6) derrick barges that can lift in excess of six thousand (6,000) tons, they are extremely costly and limited as to the water depth in which they can operate.

However, when very large loads of, for example six thousand–ten thousand (6,000–10,000) tons are involved, the limitation of the derrick barge usually prohibits such a placement on an offshore jacket. The topside must then be pieced and finished offshore.

In U.S. Pat. No. 4,714,382 issued to Jon Khachaturian there is disclosed a method and apparatus for the offshore installation of multi-ton prefabricated deck packages on partially submerged jacket foundations. The Khachaturian patent uses a variable dimensional truss assembly is supported by the barge and forms a load transfer interface between the barge and the deck package. Upper and lower connections form attachments between the truss members and the deck package at upper and lower elevational positions on the deck package. The variable dimension truss includes at least one member of variable length, in the preferred embodiment being a winch powered cable that can be extended and retracted by winding and unwinding the winch. Alternate embodiments include the use of a hydraulic cylinder as an example.

An earlier patent, U.S. Pat. No. 2,598,088 issued to H. A. Wilson entitled "Offshore Platform Structure and Method of Erecting Same" discusses the placement of drilling structure with a barge wherein the legs of the drilling structure are placed while the drilling structure is supported by two barges. The Wilson device does note use truss-like lifting assemblies having variable length portions which are placed generally on opposite sides of the deck package. Rather, Wilson relates to a platform which is floated in place and the support legs are then placed under the floating platform. Thus, in the Wilson reference, an in-place underlying supporting jacket is not contemplated.

The Natvig, et al U.S. Pat. No. 3,977,346 discusses a method of placing a deck structure upon a building site such as a pier. The method includes the pre-assembly of a deck structure upon a base structure on land so that the deck structure extends outwardly over a body of water. Floating barges are provided for supporting the deck structure outwardly of the building site. The deck structure is then transferred to the supportive base structure by means of barges. The Natvig reference uses two barges which are placed on opposite sides of a platform with pedestal type fixed supports forming a load transfer member between the barges and the platform. However, the fixed pedestal of Natvig is unlike the truss-like lifting arrangement of applicant which include movable portions at least one of which can be of a variable length.

U.S. Pat. No. 4,249,618, issued to Jacques E. Lamy, discloses a method of working an underwater deposit comprising the following stages: a) constructing an positioning a platform structure, equipped before or after positioning with drilling devices and installations, b) executing drilling using these devices and installations, c) constructing and equipping, during stages a) and b), a production bridge fitted with devices and installations required for production, d) transporting the production bridge to, and positioning it on, said platform structure, and e) commencing production from deposit. The drilling bridge may remain in position on the platform structure during stages d) and e) or it may be removed to make way for the production bridge.

U.S. Pat. No. 4,744,697, issued to Anton Coppens, discloses a vessel that is provided for installing or removing a module on or from a support structure erected in a body of water. The vessel is able to suspend the module over the support structure by cranes enabling installation or removal of the module to be accomplished while the module is being suspended.

U.S. Pat. No. 5,037,241, issued to Stephen D. Vaughn et al. discloses an improved apparatus for setting a deck structure or other marine superstructure using a barge mounted cantilevered support structure. The cantilevered support structure is attached at one end of a floating vessel. The cantilevered support structure extends past the edge of the vessel and, in one embodiment, includes means for rotating parallel support members about the deck of the floating vessel permitting the cantilevered support structure to be raised and lowered while it remains substantially parallel with the top of the offshore platform enabling the superstructure to engage the top of a previously installed offshore platform in a synchronized manner. Alternatively, this superstructure may be aligned directly over the platform. A cantilevered drilling rig is then aligned over the cantilevered support structure and used to lift the deck structure or marine superstructure, permitting the vessel and cantilevered support structure to move. The drilling rig is then used to lower the marine superstructure onto the top of the previously installed offshore platform.

BRIEF SUMMARY OF THE INVENTION

The present invention provides an improved method and apparatus for the lifting and/or placement of a multi-ton package such as a deck package, jacket, or sunken vessel. Also the present invention provides an improved method and apparatus for the removal of a multi-ton package from a marine environment, water surface, or ocean floor (i.e., sunken vessel) or from an offshore jacket.

The present invention discloses an improvement to the variable dimension truss assembly disclosed in U.S. Pat. No. 4,714,382 incorporated herein by reference.

The apparatus includes one or more barges defining a base that supports the large multi-ton load of the deck package.

In the preferred embodiment, truss-like lifting device includes a barge mounted on each side of the deck package to be lifted during operation.

In the preferred embodiment, two barges are used respectively, each having at least one truss-like lifting device on its upper deck surface. The truss preferably includes inclined and opposed booms mounted respectively on each barge, and a horizontal chord member of variable length that employs a cable wound upon a winch on each barge so that the cross-sectional dimensions of the truss can be varied by paying out or reeling in cable from the winch.

The truss forms a load transfer between each barge and the package to be lifted (e.g., deck package, or jacket) and/or placed. Upper and lower connections are formed between the lifting truss and the deck package at respective upper and lower elevational positions.

Power is provided, preferably in the form of the winch and its cable mounted on each barge for changing the length of the horizontal chord, variable length member of the truss so that elevational position of the deck package with respect to the barge can be varied such as during a lifting or lowering of the package (such as to or from a jacket foundation).

In the method of the present invention, the multi-ton deck package is first transported on a transport barge to the site where it will eventually assist in the drilling oil and/or production of a well.

In the preferred embodiment, a lifting assembly is attached to the package on generally opposite sides of the package and at upper and lower positions.

One element of the truss-like lifting assembly preferably includes a movable horizontal chord portion which has a variable length. In the preferred embodiment, the movable portion is a winch powered cable extending from each winch to a padeye connection on the package (e.g., using sheaves) to be lifted or lowered, wherein the cable can be extended or retracted between the lift barge and the deck package being lifted or lowered.

In the preferred embodiment, two lift barges support respectively first and second pluralities of truss-like lifting assemblies which in combination with the package form an overall truss arrangement. That is, the deck package itself can form a portion of the truss during the lift (typically carrying tension), and may carry both compression and tension loads.

In the preferred embodiment, the truss-like lifting assemblies have multiple booms (e.g., four) on each barge that are connected at their upper end portions to the package using a boom lifting end portion that elevates to engage a receptacle on the package. An improved connection between the booms and package is provided that uses a specially configured lifting end portion on each boom and a corresponding number receptacles on the deck package (e.g., welded thereto).

The lifting end portions support the package and can elevate it above the surface of any transport barge, so that the transport barge can be removed as a support for packages such as jackets or deck packages. This allows the package to be placed vertically above a jacket foundation and aligned with the foundation so that the deck package can be placed upon the foundation by lowering. In the case of a jacket, the transport barge can be removed so that the jacket can be lowered into the water and floated prior to installation.

The present invention allows a dimensional change in the cross-sectional configuration of the truss with respect to a vertical cross section of the truss and provides a means of raising and lowering the selected package.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
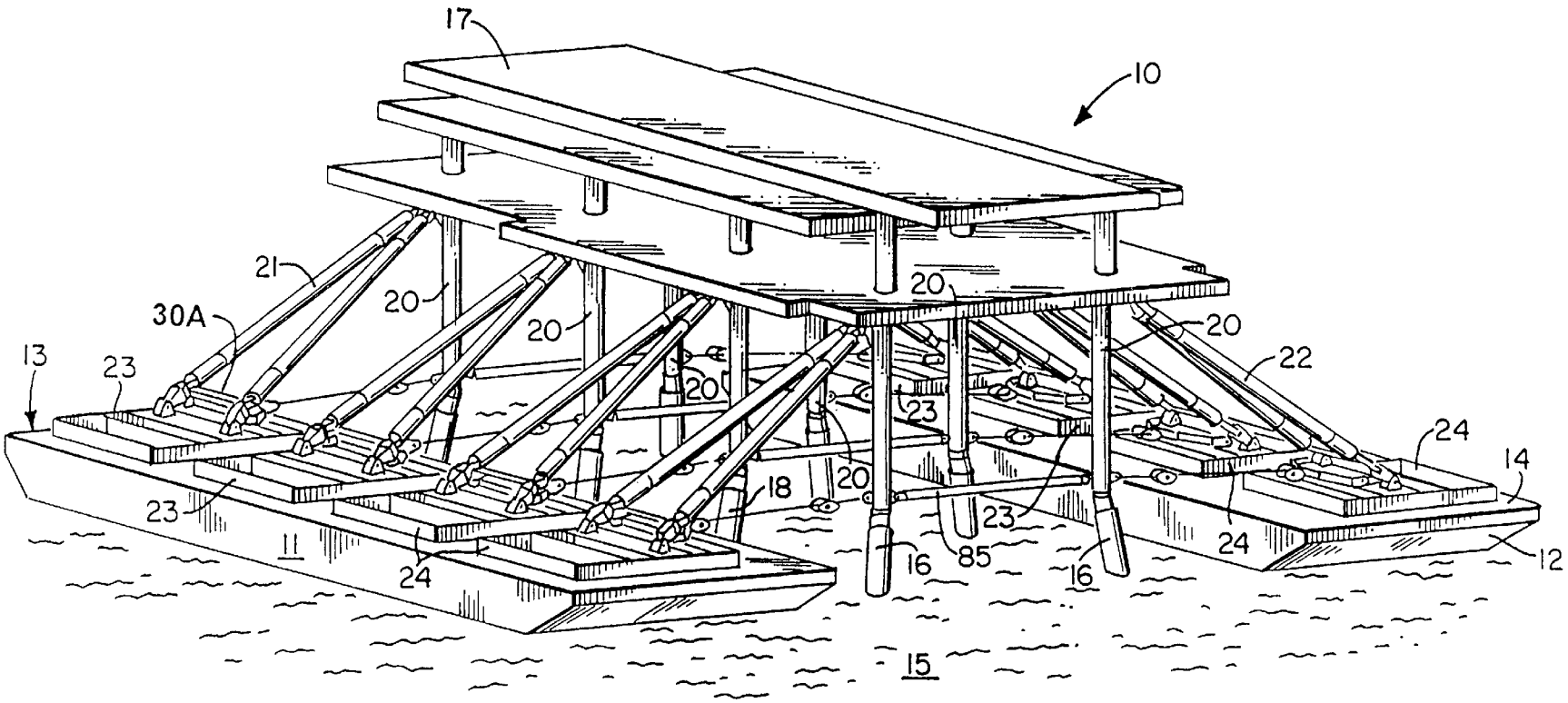
FIG. 1 is a perspective view of the preferred embodiment of the apparatus of the present invention.
Figure 2:
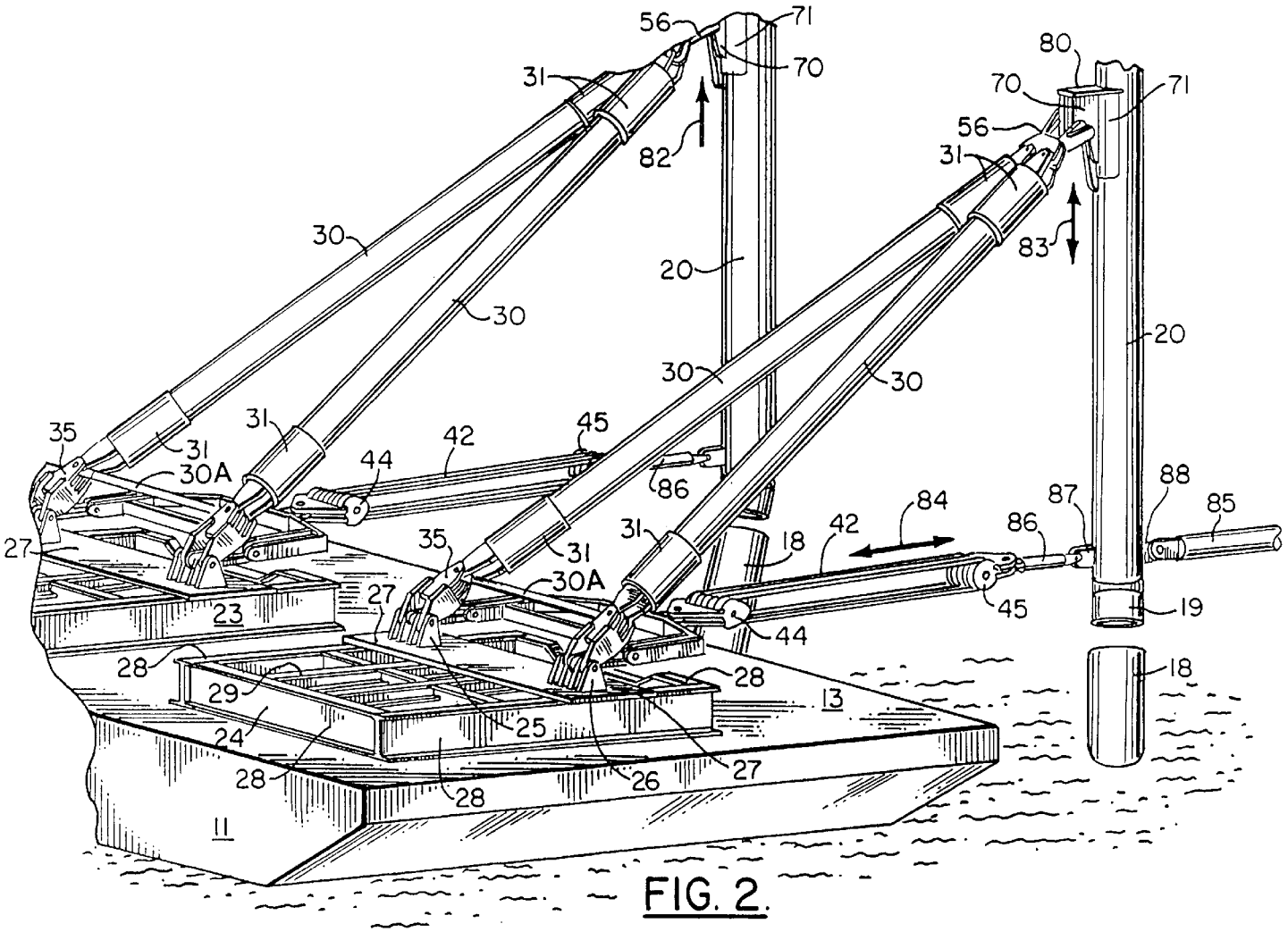
FIG. 2 is a partial perspective view of the preferred embodiment of the apparatus of the present invention.

FIGS. 1 and 2 show generally the preferred embodiment of the apparatus of the present invention designated generally by the numeral 10 in FIG. 1. Lifting apparatus 10 utilizes a pair of spaced apart marine barges 11, 12 each having a respective deck 13, 14. The barges 11, 12 float on water surface 15 adjacent an underwater jacket 16 having its uppermost portion exposed in the form of a plurality of vertical columns 18 as shown in FIGS. 1 and 2.

The use of underwater jackets 16 for the purpose of supporting any number of offshore structures is well known in the art. Typically, a drilling platform, production platform, machine shop, storage facility, or like offshore structure is manufactured on land as a heavy deck package and then transported to a selected offshore marine location for placement on a jacket 16. The jacket is also usually manufactured on land as a one-piece unit, towed to a selected site on a transport vessel such as a barge, and then transferred from the barge to the marine environment. The lower end portion of the jacket engages the ocean floor or seabed with the upper vertical columns 18 extending above the water surface 15 as shown in FIGS. 1 and 2. This procedure for placing jackets so that they can support a heavy deck package 17 in a marine environment is well known in the art.

In the past, placement of such deck package 17 upon the vertical columns 18 of a jacket 16 has been accomplished using large lifting devices known as derrick barges, a huge barge having a crane thereon with a multi-ton lifting capability.

In my prior U.S. Pat. No. 4,714,382, there is provided a variable truss arrangement that uses two spaced apart barges for placing a deck package on a jacket. The Khachaturian '382 patent uses a variable dimensional truss assembly that is supported by the barge and forms a load transfer interface between the barge and the deck package. Upper and lower connections form attachments between the truss members and the deck package at upper and lower elevational positions on the deck package. The upper connection in the '382 patent is a pinned connection. The variable dimension truss of the '382 patent includes at least one member of variable length, in the preferred embodiment being a winch powered cable that can be extended and retracted by winding and unwinding the winch.

The present application relates to improvements to the subject matter of prior U.S. Pat. No. 4,714,382 which is incorporated herein by reference.

In FIG. 2, the deck package 17 is spaced above the vertical columns 18 of jacket 16. In order to place the deck package 17 on the jacket 16, the lifting apparatus 10 of the present invention slowly lowers the deck package 17 to the jacket 16 until lower end portions 19 of the deck package 17 engage and form a connection with the vertical columns 18 of the jacket 16.

Deck packages 17 are usually constructed of a plurality of welded steel pipe members including at least some of the members that are vertical. In FIGS. 1 and 2, a plurality of vertical members 20 are shown, each having a lower end portion 19 that connects with the vertical columns 18 of jacket 16.

Each of the barges 11, 12 carries a plurality of booms 21, 22. The first barge 11 has four booms 21 in FIGS. 1 and 2. Likewise, the second barge 12 has four correspondingly positioned booms 22. In FIGS. 1 and 2, the booms 21, 22 are equally spaced along the deck 13 or 14 of the corresponding barge 11 or 12 and corresponding to the position and horizontal spacing of the vertical members 20 of package 17. Further, each of the booms 21, 22 is supported upon a load spreader platform 23 or 24. The load spreader platform 23, 24 can be a combination of static load spreader platforms 23 and movable load spreader platforms 24. For example, if each barge 11, 12 has three booms, one platform 24 can be movable. If four booms, two or three platforms 24 can be movable.

The static load spreader platforms 23 are rigidly welded to and connected to the deck 13 of barge 11, or to the deck 14 of barge 12. Base plate 27 is rigidly welded to platform 23. Each load spreader platform 23, 24 has a pair of spaced apart boom heel pin padeyes 25, 26 mounted on structural base plate 27. The base plate 27 can be welded for example to its load spreader platform 23 if a "fixed" platform 23 is desired.

Each load spreader platform 23, 24 can be constructed of a plurality of perimeter beams 28 and a plurality of internal beams 29 with plate 27 mounted thereon.

Figure 8:
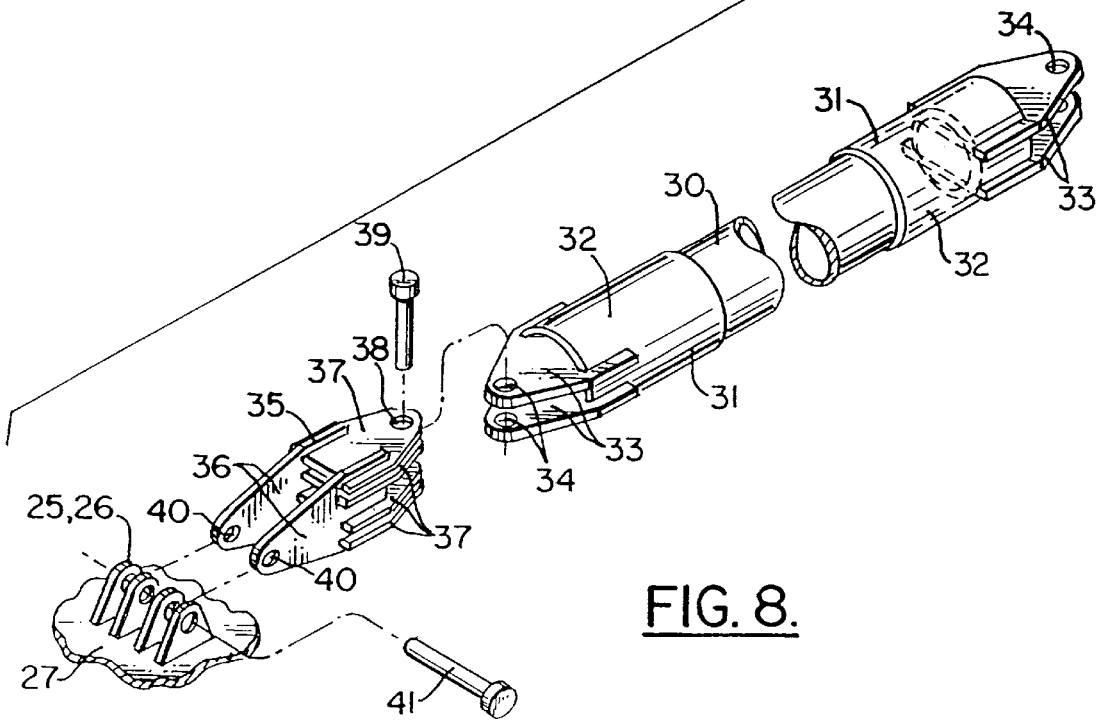
FIG. 8 is a perspective fragmentary view of the preferred embodiment of the apparatus of the present invention illustrating the boom and heel pin padeye portions thereof.
Figure 10:
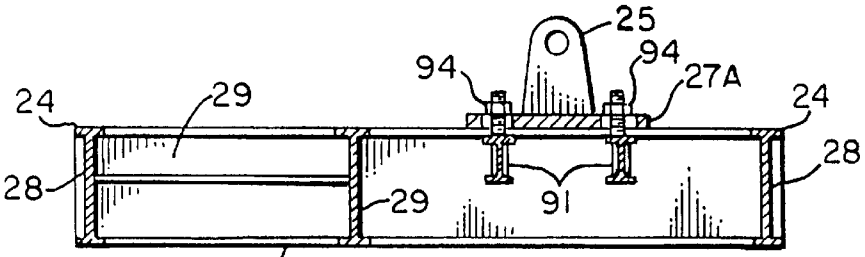
FIG. 10 is a sectional view taken along lines 10—10 of FIG. 9.

The booms 21, 22 can be constructed of a pair of diagonally extending compression members 30 that form an acute angle. In FIGS. 1–2 and 8, each compression member 30 has a pair of spaced apart end caps 31 attached to each of its end portions. This is preferably a removable connection so that compression members 30 of differing lengths can be used for different lifts and the end caps 31 can be reused. Cross bar 30A spans between connecting members 35 as shown in FIG. 1, its ends being connected to members 35 using pinned connections with pins 39.

Each end cap 31 is preferably comprised of a cylindrical sleeve 32 and a plurality of plate members 33 as shown in FIG. 8. Each plate member 33 has an opening 34 that receives a pin 39. Connecting members 35 form a pinned connection with end cap 31 as shown in FIGS. 1, 2, and 8. The connecting member 35 includes a plurality of plates 36 that are parallel and a second plurality of plates 37 that are perpendicularly positioned with respect to the first plates 36 as shown in FIG. 8.

Each of the plates 37 has an opening 38 for accepting pin 39 when the connecting member 35 is attached to end cap 31 as shown in FIGS. 2 and 8. The connecting member 35 has openings 40 in each of the plates 36. This enables the plates 36 to be attached with a pinned connection to the heel pin padeyes 25, 26 as shown in FIGS. 2 and 8.

A variable length tensile member 42 extends between heel pin padeyes 25, 26 and a vertical member 20 of package 17. As shown in FIG. 1, this centers a variable length tensile member 42 and a boom 21 or 22 on each vertical member 20. As shown in FIG. 1, there are four spaced apart vertical members 20, each having a respective boom 21 or 22 connected thereto and each having a variable length tensile member 42 extending from the barge 11 or 12 to the vertical member 20.

Figure 2A:
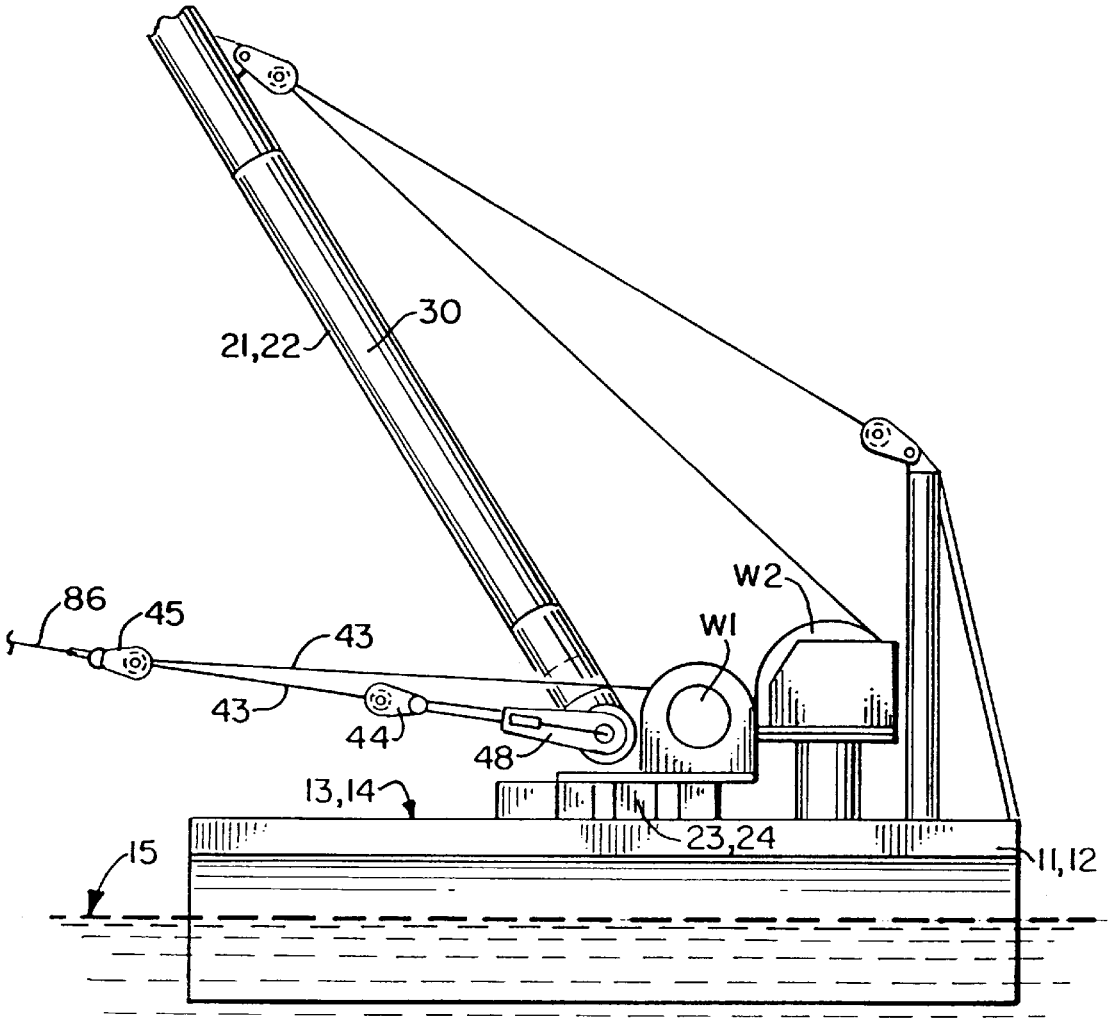
FIG. 2A is a partial sectional elevational view of the preferred embodiment of the apparatus of the present invention.
Figure 7:
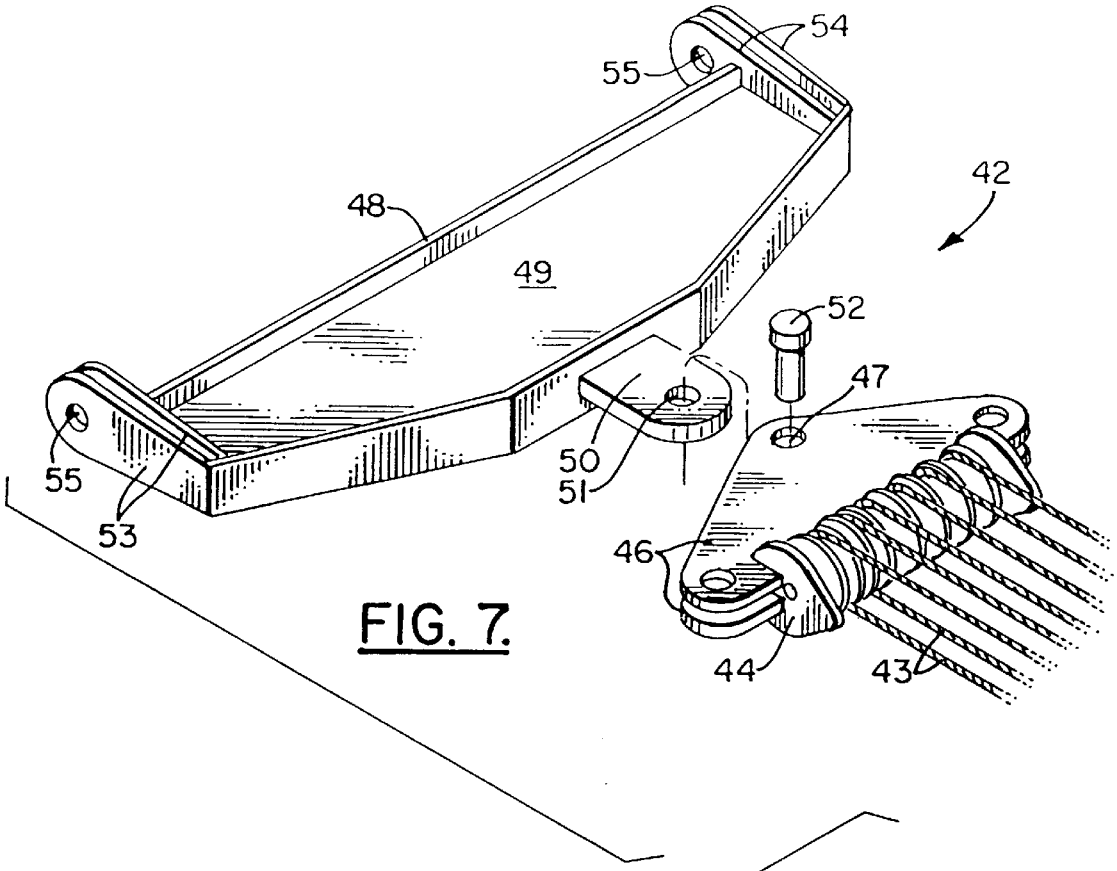
FIG. 7 is a fragmentary perspective view of the preferred embodiment of the apparatus of the present invention illustrating the bridle plate and variable length tensile member portions thereof.

Each variable length tensile member 42 includes a cable 43 wound upon a pair of sheaves 44, 45 as shown in FIGS. 2, 2A, and 7. The sheave 45 is constructed of a pair of plates 46 that are spaced apart so that padeye 50 fits in between the plates 46. A pinned connection can be formed between padeye 50 and plates 46 of sheave 44 using pin 52 that is inserted through the openings 47 of plate 46 and the opening 51 of padeye 50.

The padeye 50 is structurally connected (welded, for example) to bridle plate 48. The bridle plate 48 includes a structural plate body 49 having a pair of plates 53 and 54 at its end portions respectively as shown in FIG. 7. Each of the plates 53, 54 has openings 55 through which pin 41 can be inserted when the plates 53 or 54 are connected to respective heel pin padeyes 25, 26, as shown in FIGS. 2 and 7 e.g., with a load cell 89.

Each boom 21, 22 provides a lifting end portion 56 that is shown particularly in FIGS. 2 and 3–6. The lifting end portion 56 of each boom 21, 22 forms a connection with a receptacle 70 that is mounted on vertical member 20 as shown in FIGS. 1, 2, 5, and 6. The lifting end portion 56 is constructed of a plurality of spaced apart parallel plates 57. Each plate 57 has an opening 58. Gaps 59, 60 are provided for receiving plates 33 of an end cap 31. This connection can be seen in FIGS. 2 and 6. The lifting end portion 56 provides a pair of inner plates 61 that can be parallel to one another and a pair of outer plates 62 that can form an acute angle.

Figure 3:
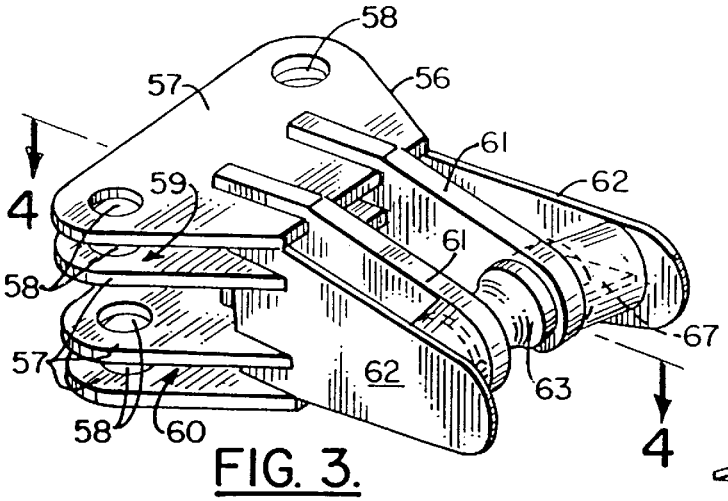
FIG. 3 is a perspective fragmentary view of the preferred embodiment of the apparatus of the present invention illustrating the lifting end portion thereof.
Figure 4:
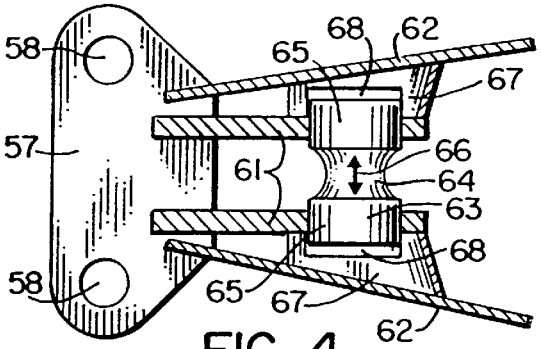
FIG. 4 is a sectional view taken along lines 4—4 of FIG. 3.

Roller 63 is positioned in openings formed through the plates 61 as shown in FIGS. 3 and 4. Each roller 63 is preferably of an hour glass shape, having a narrow or neck portion 64 and a pair of cylindrically-shaped end portions 65. Arrow 66 in FIG. 4 illustrates that the roller 63 can move side to side for adjustment purposes when the booms 21 and 22 are connected to the receptacle 70 and thus to the deck package 17. In order that roller 63 be allowed to move from side-to-side, there are provided gaps 68 on each side of the roller 63 as shown in FIG. 4. Stop plates 67 are shaped to limit movement of the roller 63 as it moves from one side to the other as shown by arrow 66.

Figure 6:
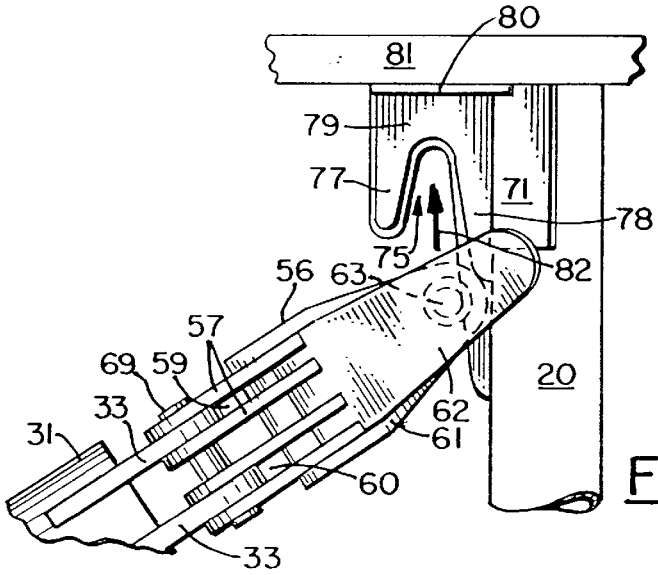
FIG. 6 is a partial sectional elevational view of preferred embodiment of the apparatus of the present invention illustrating engagement of the boom lifting end portion and receptacle such as during lifting of a heavy deck package.

Lifting end portion 56 can be connected to the selected boom 21 or 22 with pin connections 69 as shown in FIG. 6. The openings 58 in plates 57 receive a pin therethrough, that pin also passing through the openings 34 in plates 33 of end cap 31.

Figure 5:
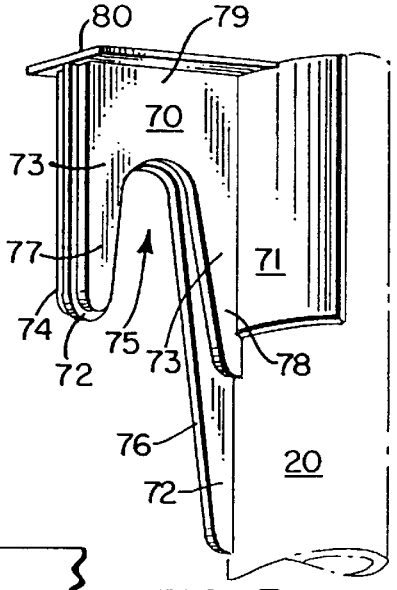
FIG. 5 is a fragmentary perspective view of the preferred embodiment of the apparatus of the present invention illustrating the receptacle portion thereof.

Receptacle 70 is shown more particularly in FIGS. 2, 5, and 6. Receptacle 70 includes a curved plate 71 that is attached to vertical member 20 of deck package 17, being structurally affixed thereto by welding, for example.

Receptacle 70 is formed of a plurality of flat plates including a center plate 72 and a pair of smaller side plates 73, 74, as shown in FIG. 5. Recess 75 receives roller 63 upon engagement of lifting end portion 56 and receptacle 70 as shown in FIG. 6. The neck 64 portion of roller 63 is of a reduced diameter and is shaped to engage inclined edge 76 of plate 72, then travel upwardly along inclined edge 76 until the neck 64 of roller 63 fully nests in recess 75 of receptacle 70. This fully engaged position of lifting end portion 56 and receptacle 70 is shown in FIG. 2.

The receptacle 70 is formed of a pair of vertical sections 77 and 78, and a transversely extending section 79. The section 79 can have a flat upper surface that receives reinforcing plate 80, that can be a horizontally extending plate. In FIG. 6, further reinforcement of the attachment of receptacle 70 to deck package 17 is seen. In FIG. 6, the horizontal plate 80 is rigidly affixed to the bottom of a horizontal beam 81 by welding, for example. This enables the loads transmitted from lifting end portion 56 to receptacle 70 to be transferred to the deck package 17 at vertical member 20 and at horizontal beam 81.

In FIGS. 2 and 6, arrows 82 illustrate the upward movement of lifting end portion 56 that is used to nests roller 63 in recess 75 of receptacle 70. In FIG. 2, arrow 83 illustrates the upward and downward movement of lifting end portion 56 of booms 21 and 22 to either engage or disengage the boom 21 or 22 from the deck package 17.

In order to lower the deck package 17, the cable 43 is unwound using a winch that is carried on the surface of deck 13 or 14 of barge 11 or 12. This lengthens the distance between heel pin padeyes 25, 26 and the deck package 17. By lengthening the distance between the padeyes 25 and 26 of the respective barges 11 and 12, the variable length tensile member 42 is elongated so that the booms 21 and 22 rotate downwardly about their heel pin padeyes 25, 26 creating a smaller and smaller angle between the compression members 30 and the barge decks 13, 14.

This procedure is reversed in order to lift a deck package 17 upwardly with respect to water surface 15 and jacket 16. In such a lifting situation, the winch mounted on the deck 13 or 14 of the barges 11 and 12 winds the cable 43 to shorten the distance between sheaves 44, 45. This likewise shortens the distance between the heel pin padeyes 25 and 26 on barge 11 with respect to the heel pin padeyes 25 and 26 on barge 12. The effect is to elevate the lifting end portion 56 and to increase the angle between the compression members 30 and the barge decks 13, 14.

In such a lifting situation, tension member 85 can be used in between opposed vertical members 20 as shown in FIGS. 1 and 2. Padeyes 87, 88 can be welded, for example, to vertical member 20 for forming an attachment between tension member 85 and the vertical column 20. Likewise, a tension member 86 can be placed in between padeye 87 and sheave 45 as shown in FIG. 2. Thus, a continuous tensile member is formed in between the heel pin padeyes 25, 26 of barge 11 for each boom 21, and the corresponding heel pin padeyes 25, 26 on barge 12 for each of its booms 22.

During a lifting of a package 17, hook-up is first accomplished. The booms 21, 22 are positioned so that the lifting end portion 56 of each boom 21, 22 is positioned below the corresponding receptacle 70 on package 17.

An operator or operators then begin hook-up by attaching the cables 43 and sheaves 44, 45 to the corresponding vertical members 20, configured as shown in FIGS. 1, 2, and 2A. The winch W1 then shortens cable 43 pulling barges 11, 12 toward package 17. In such a situation, the lifting end portion 56 will engage vertical member 20 at a position below receptacle 70. The plates 62 of lifting end portion 56 will engage vertical member 20 and end portion 56 then slides upwardly on the vertical member 20 as cable 43 is shortened until end portion 56 reaches receptacle 70. Continued shortening of the cable 43 increases the angle of inclination of each boom 21, 22 relative to the deck 13, 14 respectively of barges 11, 12 until lifting end portion 56 registers completely in recess 75 of receptacle 70. Then, continued shortening of the cable 43 associated with each boom 21, 22 effects a lifting of the padeyes 17 as the boom 21, 22 angle of inclination relative to the barge 11, 12 deck 13, 14 further increases. The booms 21, 22 are simultaneously elevated and inclined continuously so that each of the booms 21, 22 shares a substantially equal part of the load. This can be monitored using load cell link that can be used to monitor the tension between bridle plates 48 and the pinned connection that joins padeyes 25, 26 and connecting members 35.

A second winch W2 can be rigged with a wound line or cable for pivoting each boom 21, 22 relative to the deck 13, 14 of barge 11, 12 respectively (see FIG. 2A) such as may be required during an initial positioning of the booms 21, 22 before a hook-up.

Figure 9:
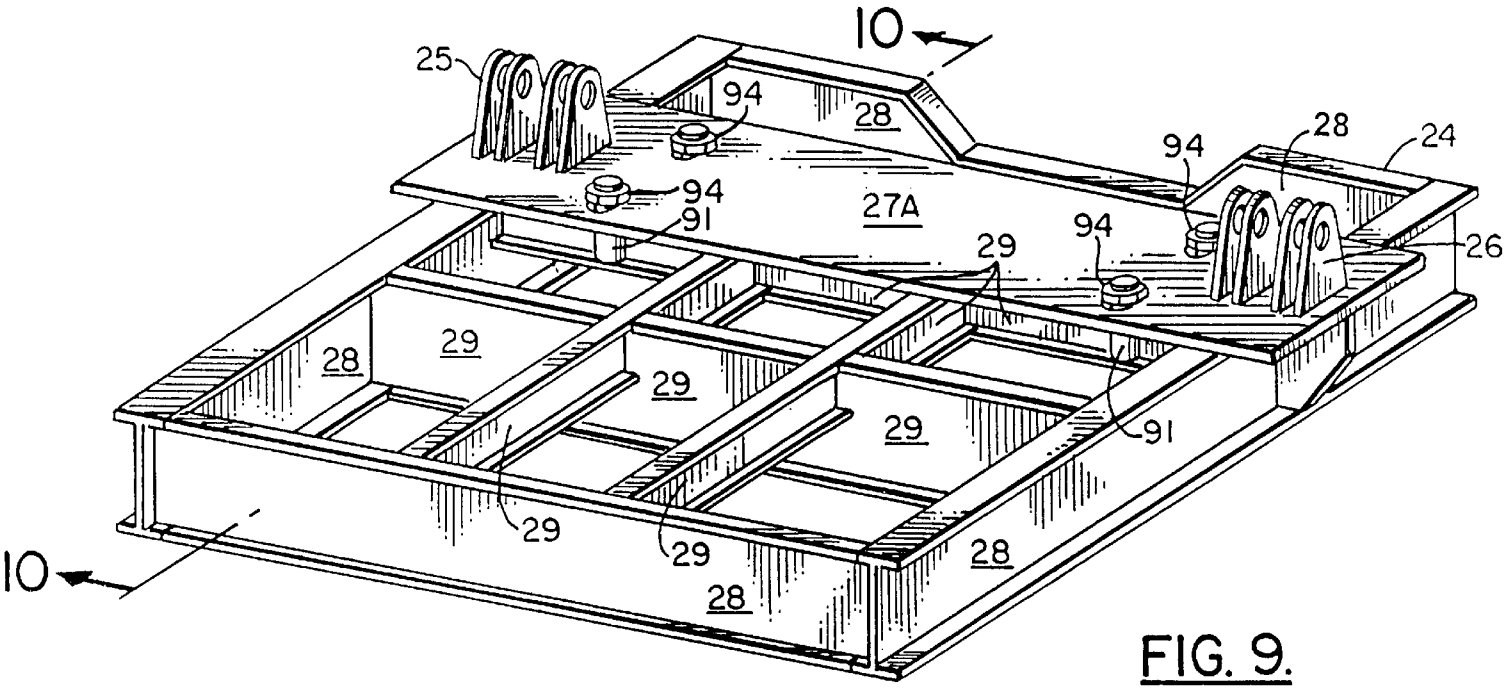
FIG. 9 is a perspective fragmentary view of the preferred embodiment of the apparatus of the present invention illustrating the movable load spreader platform portion thereof.
Figure 11:
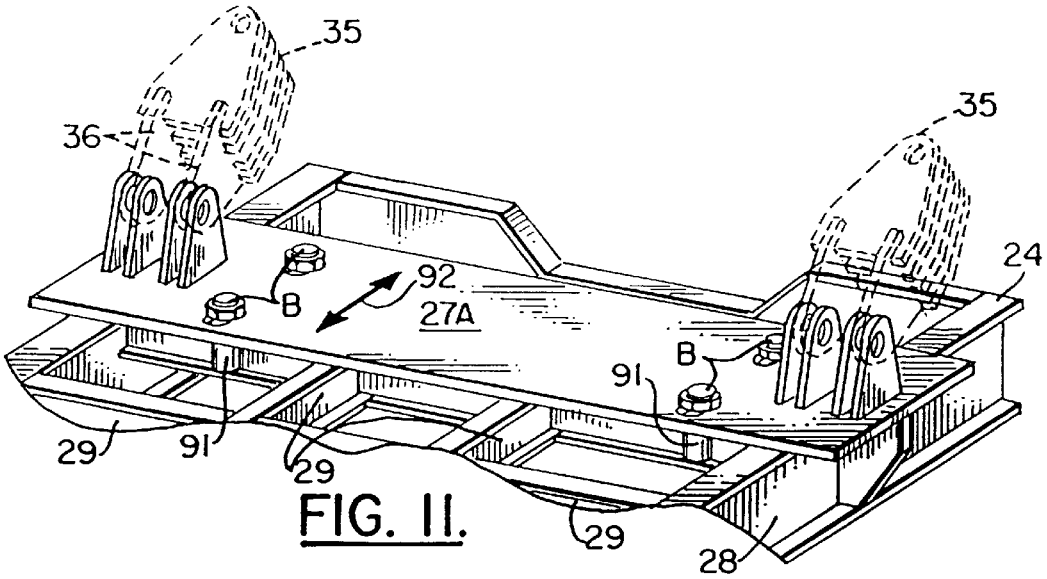
FIG. 11 is a fragmentary perspective view of the preferred embodiment of the apparatus of the present invention illustrating the movable load spreader platform portion thereof and its connection to the boom support connecting members.
Figure 12:
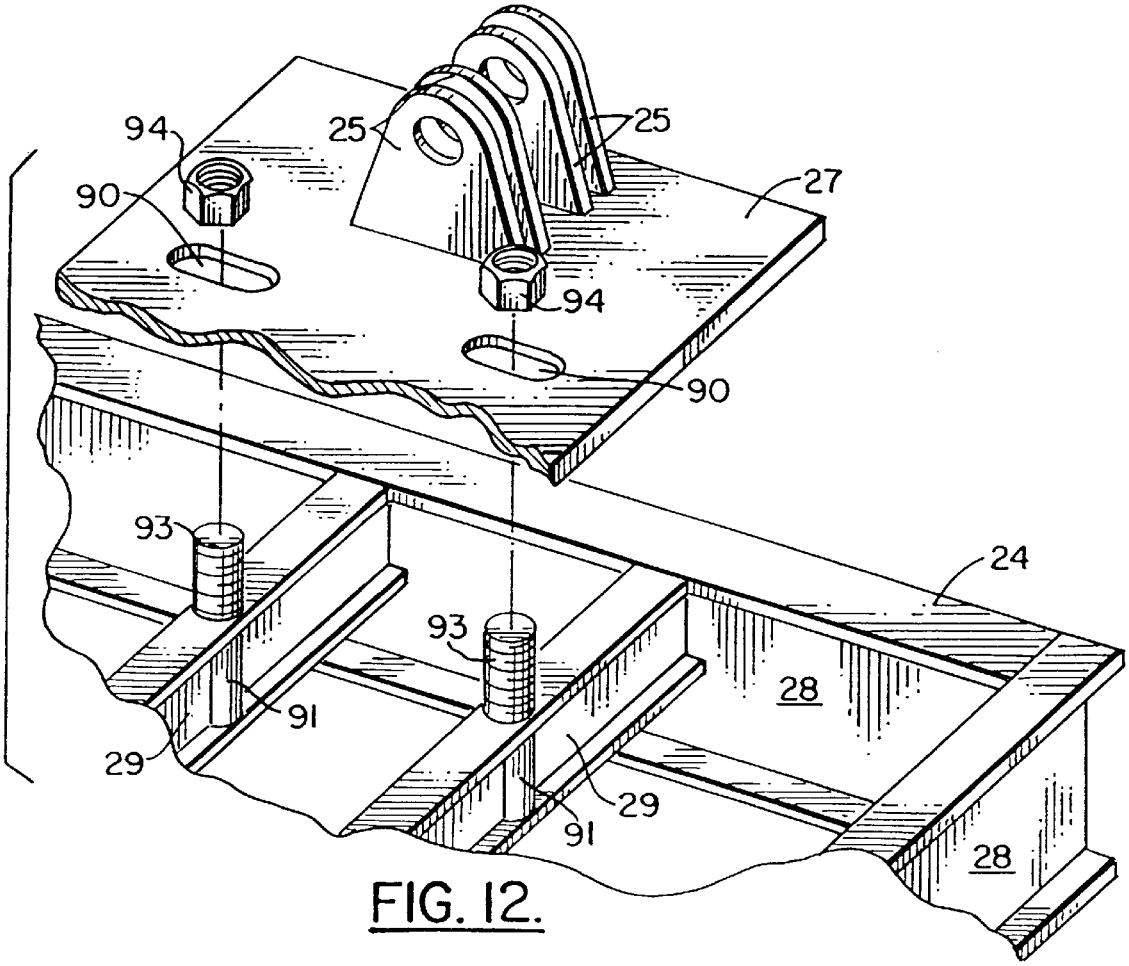
FIG. 12 is a partial perspective exploded view of the preferred embodiment of the apparatus of the present invention illustrating the movable load spreader platform portion thereof.

In FIGS. 9–12, there can be seen more particularly the construction of movable load spreader platform 24. The plate 27A in FIG. 9 is a support plate that sits upon the various perimeter beams 28 and internal beams 29 of movable load spreader platform 24. However in FIGS. 9–12, elongated slots 90 are provided for receiving bolted connections B as shown in FIG. 11. Each of the slots receives the upper threaded end portion of a bolt 91 as shown in FIGS. 9–12. In this fashion, the plate 27A can slide as shown by the arrow 92 in FIG. 11. This enables the boom 21 or 22 that is affixed to connecting members 35 some adjustment in its position with respect to the supporting barge 11 or 12. This is important because it enables minor defects in construction in either of the deck package 17 or either of the barges 11, 12 or of the various load spreader platforms 23, 24 to be compensated for during attachment of the booms 21, 22 to the deck package 17 to be lifted. The threaded upper end 93 of each bolt 91 can then receive a nut 94 to complete the bolted connection B. It should be understood that during use, it is not necessary that the bolted connections be torqued and/or tightened. This is because the compression loads transmitted from the boom 21 or 22 to the plate 27A and then to the load spreader platform is sufficient to hold the plate 27A in position not withstanding that the nuts 94 are fully tightened. In fact, during initial connection of the booms 21, 22 to the deck package 17, some adjustability of plate 27A with respect to beams 28, 29 is desirable.

Figure 13:
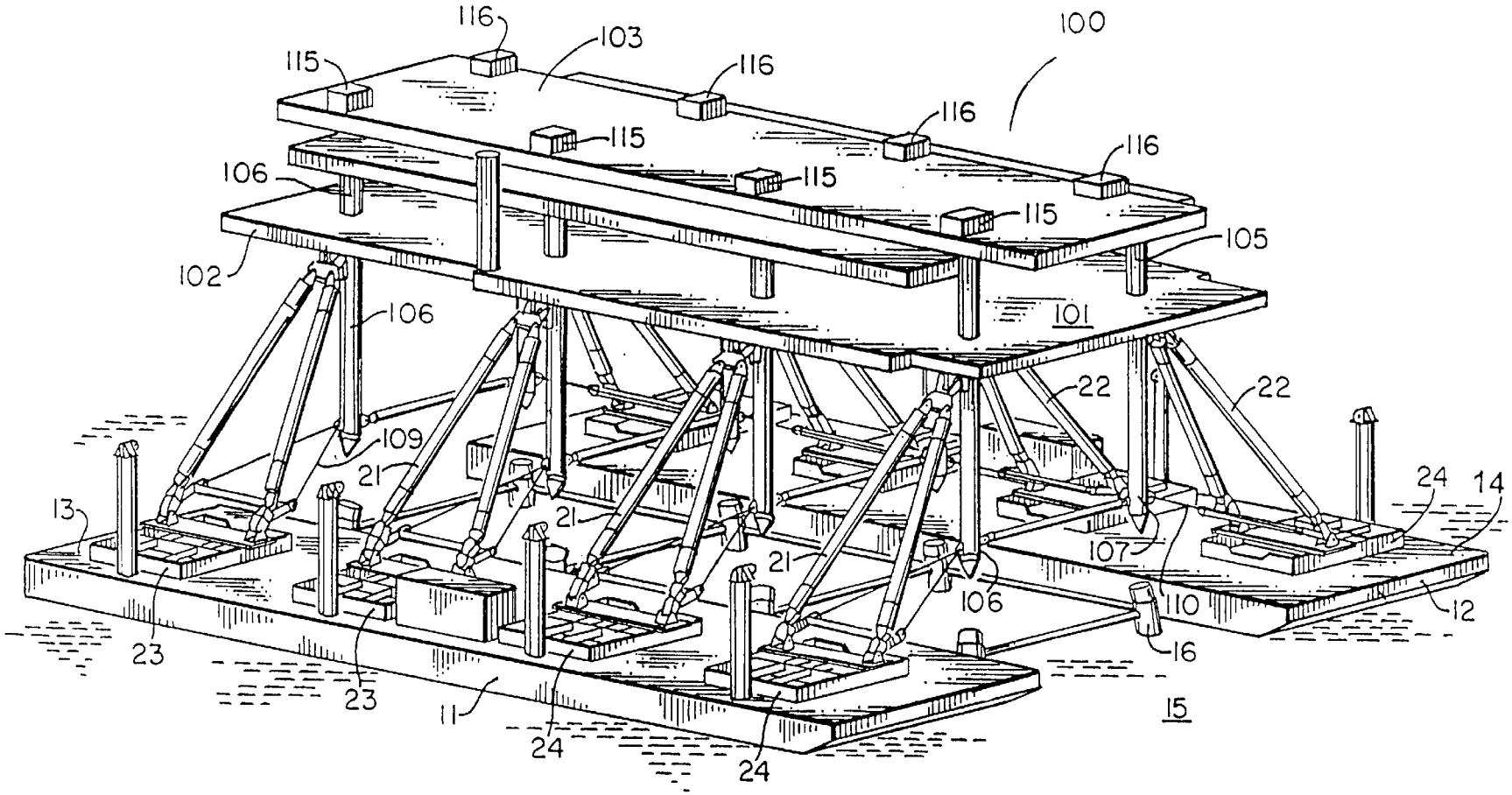
FIG. 13 is a perspective view of a second embodiment of the apparatus of the present invention.
Figure 14:
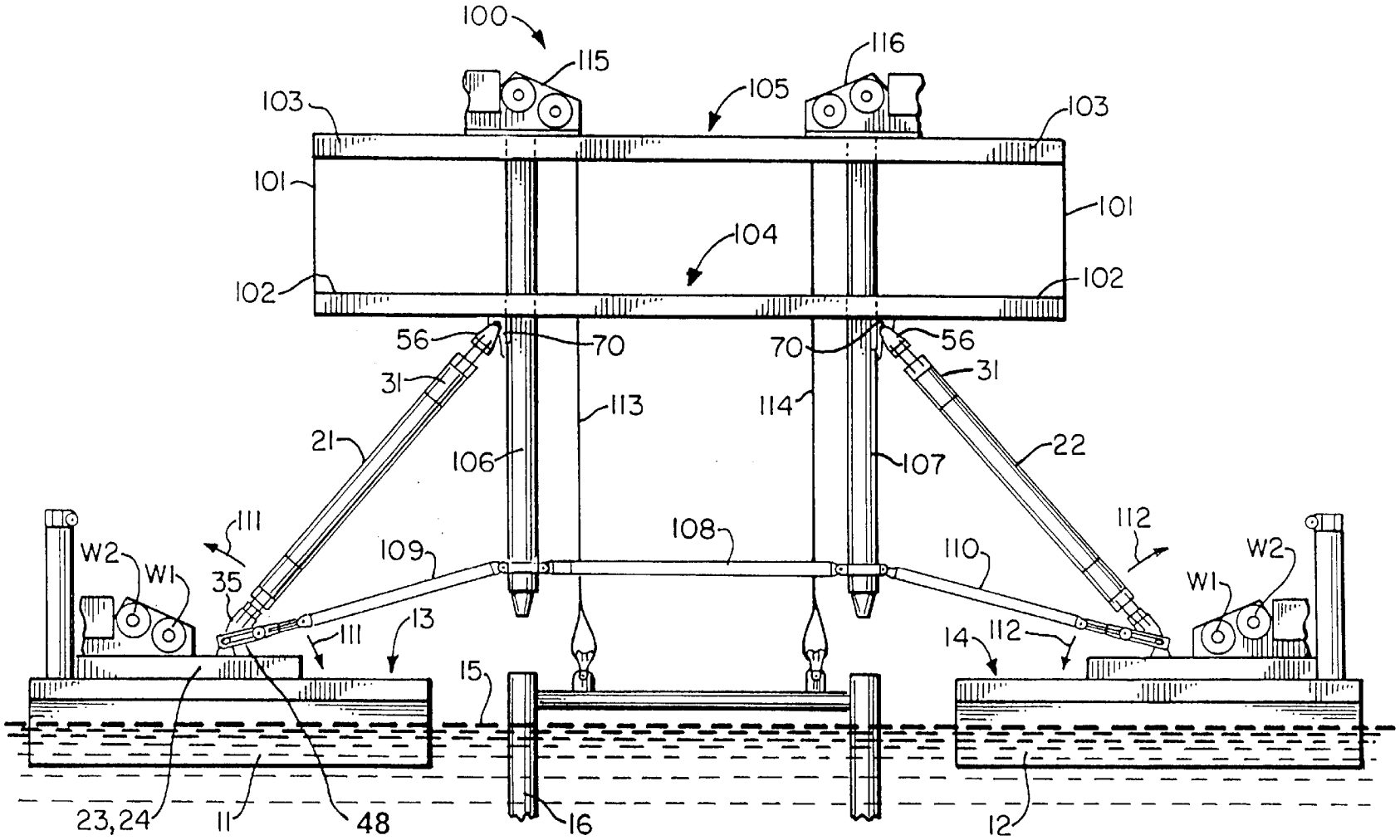
FIG. 14 is a partial, sectional, elevational view of the second embodiment of the apparatus of the present invention.

FIGS. 13 and 14 show a second embodiment of the apparatus of the present invention designated generally by the numeral 100 in FIGS. 13 and 14. In the embodiment of FIGS. 13 and 14, the variable length tensile member 42 is replaced with one or more fixed length members 109, 110 (or slings) that span respectively from barges 11, 12 to a work structure designated by the numeral 101. When the variable length tensile member 42 of the preferred embodiment of FIGS. 1–12 is replaced with the fixed length member 109, 110 of FIGS. 13 and 14, a catamaran structure 100 is provided that can be used as a work platform for servicing offshore oil and gas platforms, production facilities, well heads and the like.

The catamaran structure 100 thus includes the two barges 11, 12, the work platform 101, and the booms 21, 22 and fixed members 108, 109, 110, to rigidify the entire structure so that the only movement between the barges 11 and 12 relative to the work platform 101 is rotational or pivotal movement as shown by the arrows 111, 112, in FIG. 14. The same booms 21, 22, and barges 11, 12, are used as with the preferred embodiment to form an initial connection between each boom 21, 22, and the work platform 101 using for example, the same type of connections shown in FIG. 6 with the preferred embodiment. The lift uses receptacle 70, lifting end portion 56, end caps 31, and compression members 30. This enables the length of the booms 21, 22 to be varied, depending on the configuration desired. For example, the present invention enables barges 11 and 12 to be used with work platforms 101 of different sizes. By changing the length of the compression members 30, different work platforms 101 can be accommodated. Further, the angle between each boom 21, 22, and the water surface 15 can be varied as well, using different length compression members 30, and different length members 109, 110.

The platform 101 can be similar in configuration to the deck package 17 shown in the preferred embodiment of FIGS. 1–12. The work platform 101 can be comprised for example of a plurality of vertical columns 106, 107, and a plurality of spaced apart decks including eg. lower deck 102 and upper deck 103. Openings 107, 108 can be provided through decks 102, 103 respectively, so that lift lines 113, 114 can pass through openings 104, 105, as shown in FIG. 14. Such lift lines 113, 114, can be powered using winches 115, 116, respectively. This enables the work platform 101 to be elevated and perform many of the functions of jack-up type rigs, for example. Further, the present invention enables the apparatus 100 of the present invention to be used for lifting submerged structures such as offshore jackets 16 upwardly during salvage operations.

The use of fixed members 109, 110 in place of the variable length tensile members 42 of the preferred embodiment, provides a very stable structure 100 that is of a fixed geometry for extended use such as during transport to and from offshore locations, and functioning as a work platform or a work boat of catamaran type to perform many offshore maintenance and salvage jobs.

Figure 15:
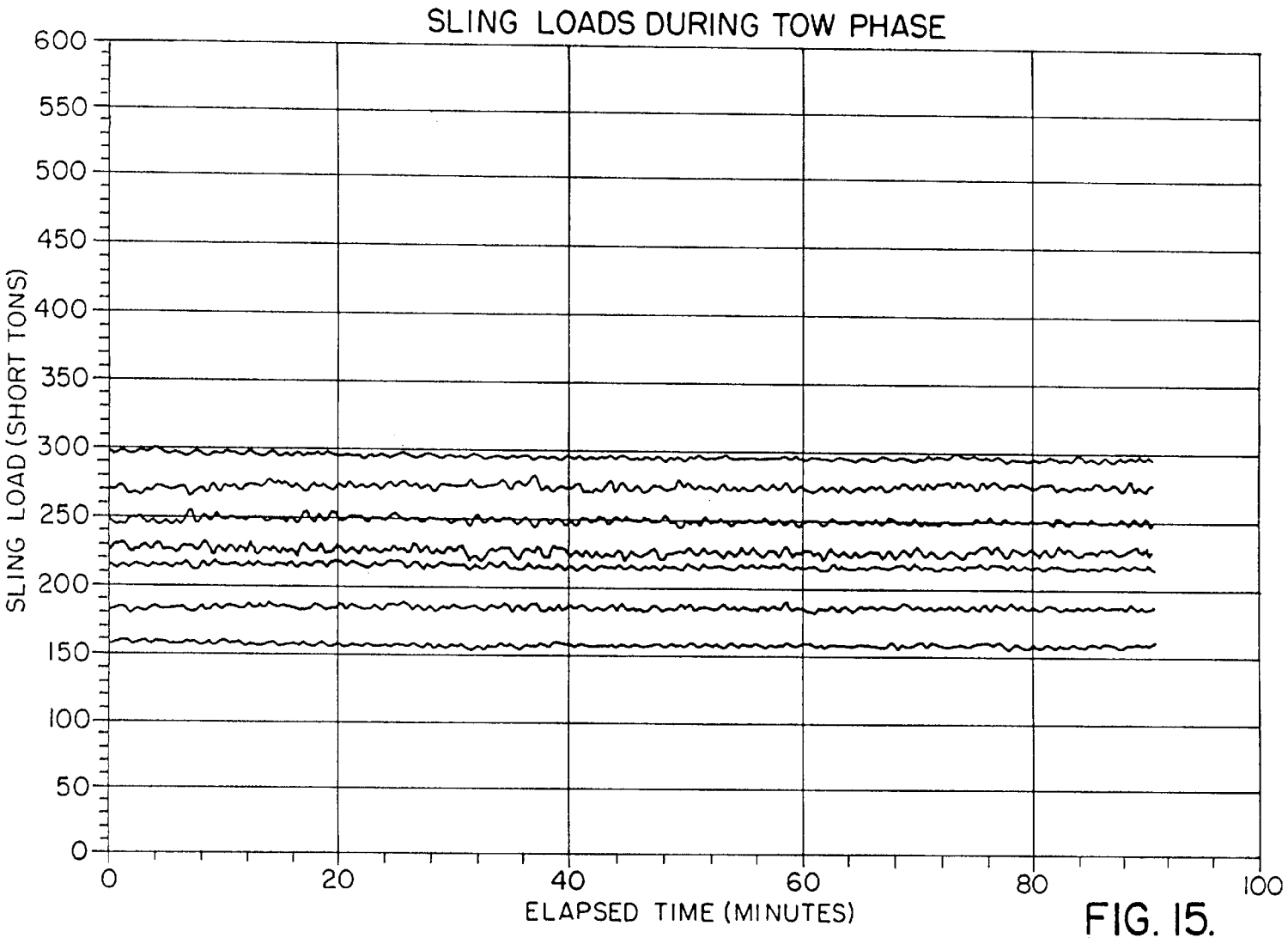
FIG. 15 is a graphical representation of sling loads for the slings 109, 110, during tow phase.

FIG. 15 shows sling loads during tow phase. The sling load (short tons) is plotted against elapsed time. During such an actual tow, the slings 109, 110 experienced little variation in sling load due to the overall stability of apparatus 100.

The following table lists the parts numbers and parts descriptions as used herein and in the drawings attached hereto.

PARTS LIST

| Part Number | Description |
|---|---|
| 10 | lifting apparatus |
| 11 | barge |
| 12 | barge |
| 13 | deck |
| 14 | deck |
| 15 | water surface |
| 16 | jacket |
| 17 | deck package |
| 18 | vertical column |
| 19 | lower end portion |
| 20 | vertical member |
| 21 | boom |
| 22 | boom |
| 23 | static load spreader platform |
| 24 | movable load spreader platform |
| 25 | boom heel pin padeye |
| 26 | boom heel pin padeye |
| 27 | floating heel pin base plate |
| 28 | perimeter beam |

-continued

PARTS LIST

| Part Number | Description |
|---|---|
| 29 | internal beam |
| 30 | compression member |
| 30A | cross bar |
| 31 | end cap |
| 32 | cylindrical sleeve |
| 33 | plate |
| 34 | opening |
| 35 | connecting member |
| 36 | plate |
| 37 | plate |
| 38 | opening |
| 39 | pin |
| 40 | opening |
| 41 | pin |
| 42 | variable length tensile member |
| 43 | cable |
| 44 | sheave |
| 45 | sheave |
| 46 | plate |
| 47 | opening |
| 48 | bridle plate |
| 49 | body |
| 50 | padeye |
| 51 | opening |
| 52 | pin |
| 53 | plate |
| 54 | plate |
| 55 | opening |
| 56 | lifting end portion |
| 57 | plate |
| 58 | opening |
| 59 | gap |
| 60 | gap |
| 61 | inner plate |
| 62 | outer plate |
| 63 | roller (hourglass shape) |
| 64 | neck |
| 65 | cylindrical end |
| 66 | arrow |
| 67 | stop plate |
| 68 | gap |
| 69 | pinned connection |
| 70 | receptacle |
| 71 | curved plate |
| 72 | plate |
| 73 | plate |
| 74 | plate |
| 75 | recess |
| 76 | inclined surface |
| 77 | vertical section |
| 78 | vertical section |
| 79 | transverse section |
| 80 | horizontal plate |
| 81 | horizontal beam |
| 82 | arrow |
| 83 | arrow |
| 84 | arrow |
| 85 | tension member |
| 86 | tension member |
| 87 | padeye |
| 88 | padeye |
| 89 | load cell link |
| 90 | slot |
| 91 | bolt |
| 92 | arrow |
| 93 | threaded portion |
| 94 | nut |
| B | bolted connection |
| W1 | winch |
| W2 | winch |
| 100 | catamaran work platform apparatus |
| 101 | work platform |
| 102 | lower deck |
| 103 | upper deck |
| 104 | opening |

-continued

PARTS LIST

| Part Number | Description |
|---|---|
| 105 | opening |
| 106 | vertical column |
| 107 | vertical column |
| 108 | transverse beam |
| 109 | fixed length member |
| 110 | fixed length member |
| 111 | arrow |
| 112 | arrow |
| 113 | lift line |
| 114 | lift line |
| 115 | winch |
| 116 | winch |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

What is claimed is:

1. A catamaran work barge apparatus comprising:

a) a pair of barges, each defining a base that can support a large multi-ton load;

b) a work platform supported respectively by the barges that can be positioned next to a package to be lifted, for forming a load transfer between the barges and the package to be lifted;

c) a plurality of diagonally extending lift booms, each lift boom having a lower end attached to a barge and an upper end that can be attached to the work platform;

d) lower connection members for forming attachments between the barges and the work platform;

e) each boom having a free end with a lifting end portion; and f) a receptacle attached to the work platform that receives the boom lifting free end portion.

2. The catamaran work barge apparatus of claim 1 wherein the lower connection members are of a fixed length during use.

3. The catamaran work barge apparatus of claim 2 wherein there are a plurality of lifting booms on each barge and the barges have horizontal load spreader surfaces spaced generally under each boom and on opposite sides of the package being lifted.

4. The catamaran work barge apparatus of claim 2 wherein the booms are each pinned to a barge and each boom is angularly disposed with respect to another boom during use, wherein each boom includes a compression member and a plurality of end caps removably attached to the ends of the compression member, wherein end caps form a detachable interface between the work platform and the compression member.

5. The catamaran work barge apparatus of claim 1 wherein the work platform includes a winch powered lifting cable.

6. The catamaran work barge apparatus of claim 1 wherein a portion of the lifting end portion slides side to side for effecting adjustment during connection of a lifting end portion to its receptacle.

7. The apparatus of claim 2 wherein the fixed length lower connections are rigid structural members.

8. The catamaran work barge apparatus of claim 1 wherein each lifting boom is an "A" frame shaped boom that comprises a pair of longitudinal boom members that form an acute angle, a pair of lifting end portions that form a detachable interface between each longitudinal boom member and a barge, the free end portion having a structural member and a pair of end caps that form a detachable connection between the longitudinal boom members and the lifting end portion.

9. The catamaran work barge apparatus of claim 3 wherein the fixed length member includes multiple cable assemblies spaced apart on each barge.

10. A method for the offshore maintenance of a fixed offshore structure comprising the steps of:

a) transporting a work platform to a desired site of the fixed offshore structure with a pair of barges that are spaced apart and generally parallel;

b) attaching a lifting assembly to the work platform at multiple positions including positions that are at least on generally opposite sides of the work platform and at upper and lower positions on the work platform respectively, the lifting assembly including a lower chord normally in tension during the lifting process and a diagonally extending boom member chord normally in compression during the lifting process;

c) wherein in step "b" the lifting assembly further includes a plurality of opposed lifting booms, each connected by at least one lifting end portion to a receptacle on the work platform; and d) using the work platform to perform maintenance on the fixed offshore structure.

11. The method of claim 10, wherein the lifting end portion includes a roller.

12. The method of claim 11, wherein the lower chord includes fixed length flexible cable.

13. The method of claim 10, wherein there are two opposed lift barges that are floating barges.

14. The method of claim 10, wherein one portion of the lifting assembly includes a plurality of compression carrying diagonally extending lift booms, each with opposing end portions and a plurality of end caps that removably attach to the end portions.

15. The method of claim 14, wherein the lifting assembly includes a plurality of non-extensible diagonally extending lift booms, each removably connecting at its ends to an end cap.

16. A method of repair or salvage of an offshore structure, comprising the steps of:

a) providing a work platform;

b) attaching a lifting assembly to the work platform at multiple elevational positions on the platform, including upper and lower positions and at the positions that are at least on generally opposite sides of the work platform;

c) wherein the lifting assembly in step "b" includes opposed floating barges having diagonally extending lifting booms thereon connected at their upper ends with a lifting end portion to a receptacle on the work platform;

d) structurally supporting each of the lifting booms at the lower end portion thereof with one of the barges, each boom being pivotally attached to its barge;

e) wherein the work platform has receptacles thereon each with a downwardly oriented recess that receives the lifting end portion of a boom as the boom inclination increases relative to the deck of the barge; and f) supporting the work platform with fixed length chords of each lifting assembly so that combination of barges and platform only pivot at the base of each boom.

17. A method of repair or salvage of an offshore structure, comprising the steps of:

a) providing a work platform;

b) attaching a lifting assembly to the work platform at multiple elevational positions on the platform, including upper and lower positions and at the positions that are at least on generally opposite sides of the work platform;

c) wherein the lifting assembly in step "b" includes opposed floating barges having diagonally extending lifting booms thereon connected at their upper ends with a lifting end portion to a receptacle on the work platform;

d) structurally supporting each of the lifting booms at the lower end portion thereof with one of the barges, each boom being pivotally attached to its barge;

e) wherein the work platform has at least one powered lift cable thereon; and f) lifting the offshore structure with the powered lift cable.

18. A method of repair or salvage of an offshore structure, comprising the steps of:

a) providing a work platform;

b) attaching a lifting assembly to the work platform at multiple elevational positions on the platform, including upper and lower positions and at the positions that are at least on generally opposite sides of the work platform;

c) wherein the lifting assembly in step "b" includes opposed floating barges having diagonally extending lifting booms thereon connected at their upper ends with a lifting end portion to a receptacle on the work platform;

d) structurally supporting each of the lifting booms at the lower end portion thereof with one of the barges, each boom being pivotally attached to its barge;

e) wherein the work platform has a plurality of powered lift cables thereon; and f) lifting the offshore structure with the powered lift cables.

19. A method for the offshore maintenance of a fixed offshore structure comprising the steps of:

a) transporting a work platform to a desired site of the fixed offshore structure with a pair of barges that are spaced apart and generally parallel;

b) attaching a lifting assembly to the offshore structure at multiple positions including positions that are at least on generally opposite sides of the offshore structure, and at upper and lower positions on the offshore structure respectively, the lifting assembly including a lower chord normally in tension during the lifting process and a diagonally extending boom member chord normally in compression during the lifting process;

c) wherein in step "a" the lifting assembly further includes a plurality of opposed lifting booms, each connected by at least one lifting end portion to a receptacle on the work platform; and d) lifting the offshore structure with the work platform.

20. A method for the offshore maintenance of a fixed offshore structure comprising the steps of:

a) transporting a work platform to a desired site of the fixed offshore structure with a pair of barges that are spaced apart and generally parallel;

b) attaching a lifting assembly to the offshore structure at multiple positions including positions that are at least on generally opposite sides of the offshore structure, and at upper and lower positions on the offshore structure respectively;

c) wherein in step "b" the lifting assembly further includes a plurality of opposed lifting booms, each connected by at least one lifting end portion to a receptacle on the work platform; and d) using the work platform to perform maintenance on the fixed structure.

* * * * *